United States Patent [19]

Földi et al.

[11] Patent Number: 4,965,876

[45] Date of Patent: Oct. 23, 1990

[54] LIGHTING APPARATUS

[76] Inventors: Tivadar Földi, Irinyi u. 36/b, 1117-Budapest; Gábor Biró, Gönczy u. 2, 1093-Budapest; Tamás Barna, Ady E. u. 9/d, 1024-Budapest; Imre Nagy, Béla u. 92, 1165, Budapest; László Vincze, Uzsoki 12, 1145-Budapest, all of Hungary

[21] Appl. No.: 357,366

[22] Filed: May 26, 1989

Related U.S. Application Data

[63] Continuation-in-part of Ser. No. 107,952, Oct. 13, 1987, abandoned.

[30] Foreign Application Priority Data

Oct. 13, 1986 [HU] Hungary ..... 4254/86

[51] Int. Cl.[5] ..... F21V 7/00

[52] U.S. Cl. ..... 362/247; 362/346; 362/240; 362/298; 350/619

[58] Field of Search ..... 362/235, 240, 241, 243, 362/238, 247, 341, 346, 347, 350, 296, 297, 298, 301, 307, 252; 350/619, 620

[56] References Cited

U.S. PATENT DOCUMENTS

| | | | |
|---|---|---|---|
| 3,264,467 | 8/1966 | Mann et al. | 362/234 |
| 3,686,940 | 8/1972 | Kockott | 362/252 |
| 4,651,257 | 3/1987 | Gehly | 362/298 |
| 4,816,694 | 3/1989 | Kuppenheimer, Jr. | 362/282 |

FOREIGN PATENT DOCUMENTS

| | | | |
|---|---|---|---|
| 1227404 | 10/1966 | Fed. Rep. of Germany . | |
| 859696 | 12/1940 | Switzerland | 362/298 |
| 282255 | 12/1927 | United Kingdom | 362/350 |

*Primary Examiner*—Ira S. Lazarus
*Assistant Examiner*—D. M. Cox
*Attorney, Agent, or Firm*—Schweitzer & Cornman

[57] ABSTRACT

A lighting apparatus is provided having a plurality N of light sources arranged annularly around the optical axis of a reflector. The efficiency of such an apparatus and its service life are improved by providing a central mirrored column which is symmetrically disposed with respect to the light sources. The column has $C_N$ or $D_N$ symmetry and reflects light emitted by the light sources away from the light sources themselves, thereby reducing the amount of light reflected back at the light sources and reducing their thermal load. The column has peaks that extend into the notional annulus on which the light sources are arranged to shield adjacent light sources from each other.

10 Claims, 3 Drawing Sheets

LIGHTING APPARATUS

Figure 1A:
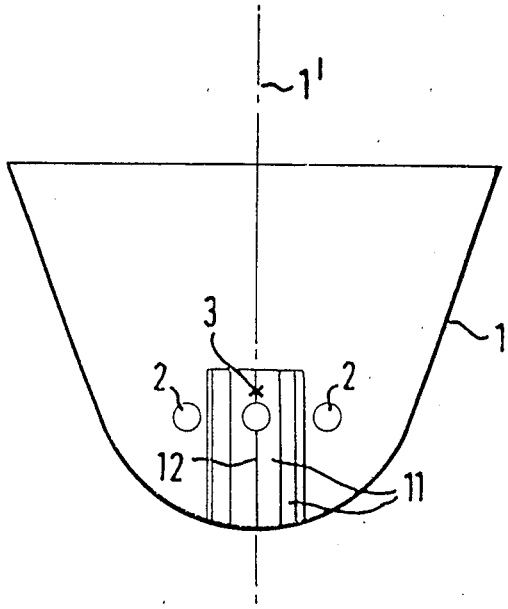

This application is a continuation in part of application No. 107,952, filed on Oct. 13, 1987, now abandoned.

The present invention relates to a lighting apparatus and in particular to a lighting apparatus that produces an intense light beam.

The light output of a lighting apparatus is generally limited by the thermal load on the light sources as a result of the heat generated by the light sources themselves; as the output of a light source is increased, so its service life decreases, due principally to the extraordinary high thermal load placed upon it. Our invention provides a lighting apparatus in which, for a given output of the apparatus, the life of the light sources is increased.

In lighting of film and television sets, it is desirable to provide a lighting apparatus that produces a single, defined shadow since lighting apparatuses that produce several shadows give an unrealistic effect. Single shadows can be generated by a single light source or bulb but the intensity of a light beam produced by a single light source is limited by the thermal load on the light source at the high temperatures necessary to produce intense light. In one embodiment, the present invention provides a lighting apparatus that emulates a single light source in that it gives a single shadow while being composed of several light sources and, as a result of using several light sources, can produce an intense light beam. Also, by the arrangement of the present invention, the light is provided at high efficiency.

DE-B-No. 1,227,404 describes a lighting apparatus comprising a parabolic mirror in which six plasma lamps are arranged annularly around a central axis. In order to improve the uniformity of a lighting apparatus, a mirror is placed within the annulus formed by the lamps; the mirror is so shaped that it reflects light from the lamps to form a virtual image of the lamps in the spaces between adjacent lamps. Thus the lighting apparatus appears to have twelve lamps (six real lamps and six virtual images) thereby providing a more homogeneous light beam than an apparatus including only six bulbs. However, such an apparatus places a high thermal load on the light sources and also produces multiple According to the present invention, there is provided a lamp structure which comprises:

(i) a concave reflector having an axis (ii) a plurality of light sources, wherein the number of light sources is N, said light sources being spaced apart within said reflector and arranged about said axis on a notional annulus (iii) a body disposed within the reflector substantially concentrically about said axis said body having a plurality of reflective segments on its surface outwardly from said axis, the number of reflective segments being N or a multiple of N, each segment viewed in cross-section having at least two curved surfaces that meet together in a peak, each light source being located opposite to the peak of a respective segment, and wherein intermediate between each pair of adjacent light sources, the body includes a further peak that extends into the notional annulus on which the light sources are arranged to shield the adjacent light sources from each other.

The said further peaks may extend partially into the said notional annulus or may pass right through the whole thickness of the annulus.

It is preferred that the central reflective body has $D_N$ or $C_N$ symmetry; an article having $D_N$ symmetry has N planes of mirror symmetry and can be rotated around an axis by 360/N degrees to provide an article of identical appearance whereas an article having $C_N$ symmetry can be rotated around an axis by 360/N degrees to provide an article of identical appearance but the article has no planes of mirror symmetry.

The body can be of constant cross-section (thereby forming a column), or it may taper (thereby forming a cone or a pyramid).

We have found that a single shadow can be obtained from a lighting apparatus containing several light sources if the reflector is a rotary-symmetric mirror the reflecting surface of which has a high order shape providing an annular focal region and if the light-emitting parts of the light sources are arranged in the vicinity of the focal region and preferably on a notional surface of the focal region. A shape of 'higher order' is a shape that can be defined by the equation $$y=a_1+a_2x^2+a_3x^3+a_4x^4+\ldots a_nx^n$$

where $a_1, a_2 \ldots a_n$ are constants and where at least one of $a_3, a_4 \ldots a_n$ are not zero, i.e. the equation includes at least one term having a power of 3 or more. A parabola is defined by the term $$y=a_1+a_2x^2$$

(where $a_1$ and $a_2$ are not zero) and so a parabola is not of a curve of 'higher order'.

Figure 1B:
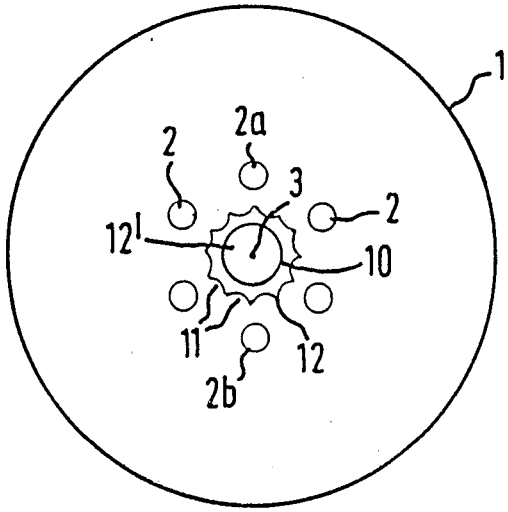
Figure 2:
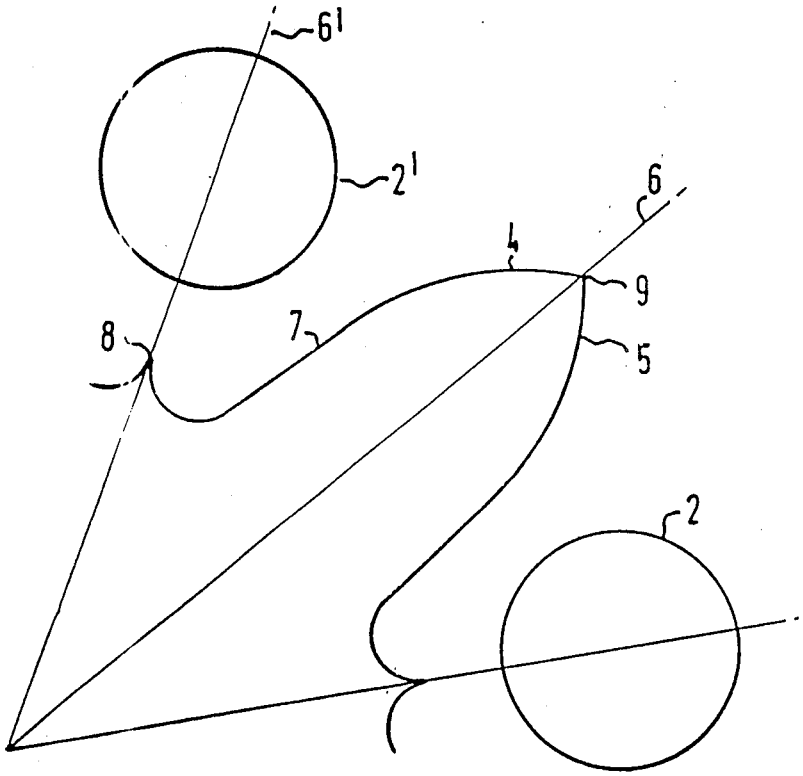
Figure 3:
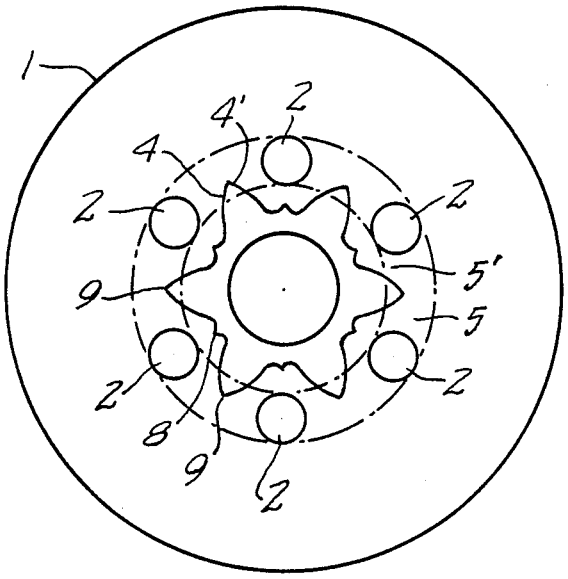
Figure 1A:
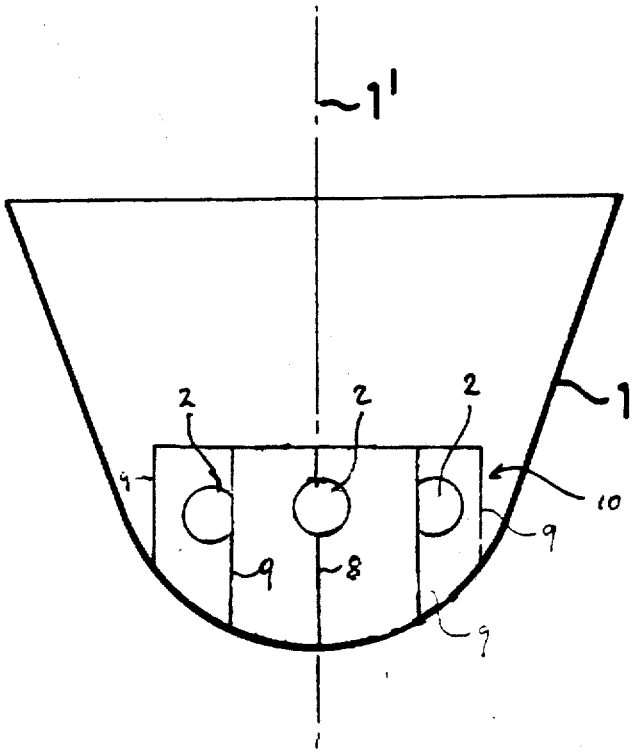
Figure 1B:
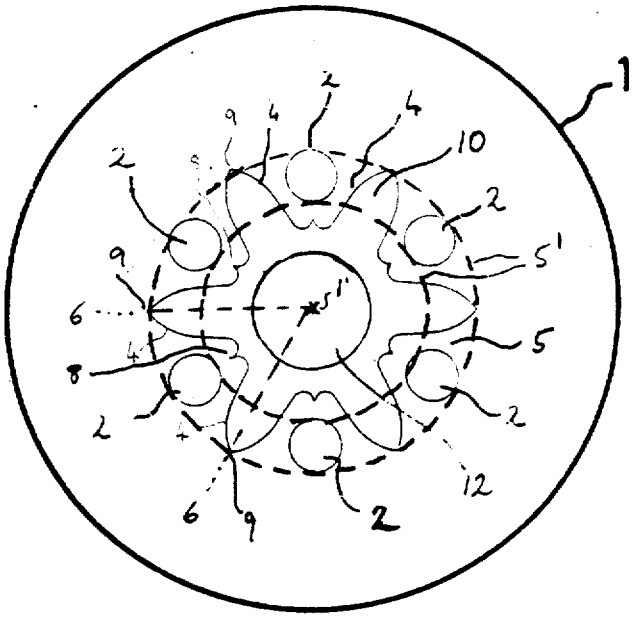
Figure 2:
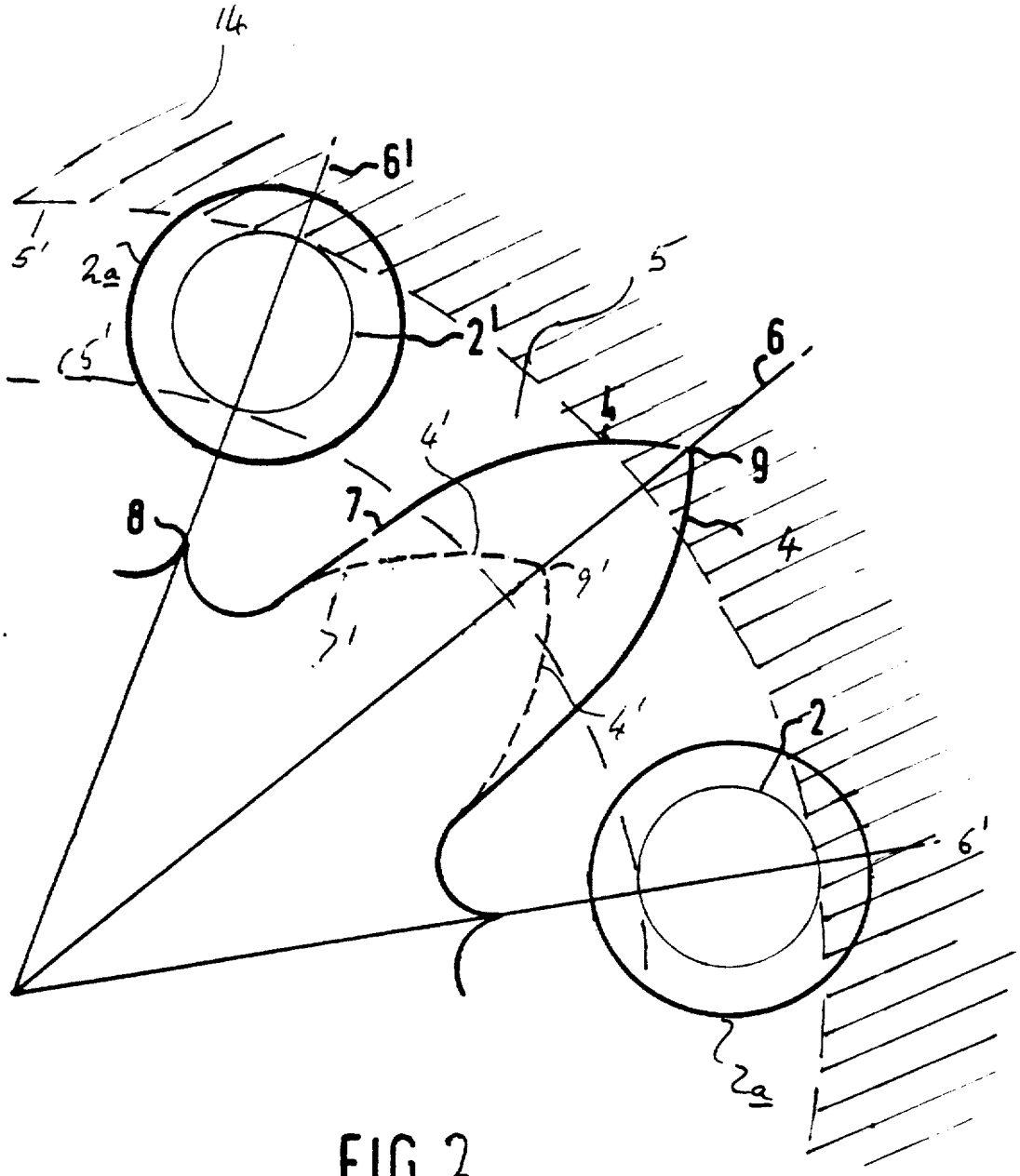

The present invention will be discussed, by way of example only, with the aid of the accompanying drawings, in which:

FIGS. 1*a* and 1*b* are a part-sectional view and a plan view of a first embodiment of the apparatus of the present invention, FIG. 2 is a detailed plan view of part of the apparatus of FIG. 1, and FIG. 3 is a plan view of a second embodiment of the apparatus of the present invention.

Referring initially to FIGS. 1*a*, 1*b* and 2, there is provided a reflector 1 having an axis 1' and made of any polishable, heat-resistant, reflecting material (e.g. stainless steel, titanium or aluminium) of any desired concave shape, e.g. parabolic but it is preferred that the reflector has a shape of higher order so that, instead of having a point focus as is the case with a parabolic reflector, the reflector has a diffused, generally annular focus 14 (shown schematically as the shaded area in FIG. 2). Six plasma light sources 2 (or light emitting parts thereof) are arranged in the vicinity of this focus and, as shown, the said light-emitting parts of the light sources are arranged on a surface of the diffused focus 14. The six plasma light sources 2 are arranged symmetrically around the optical axis 1' of the reflector on a notional annulus 5 (shown between broken lines 5').

Also arranged within the reflector is a central mirrored column 10 which is also made of stainless steel, titanium or aluminium and is formed by six segments (one such segment being shown between lines 6 in FIG. 1*b*). Each segment (when viewed in cross-section, as in FIG. 1*b*) includes at least two curved surfaces 4 that meet together in a peak 8 and each light source 2 is located opposite one of these peaks. The shapes of the surfaces 4 are such that they do not reflect light back onto the light sources 2. Adjacent segments meet together at further peaks 9, the function of which will be described in further detail below. The central mirror 10 shown in FIG. 1 has six equally-spaced planes of mirror symmetry, three passing through opposed peaks 8 and three passing through the opposed peaks 9; the mirror column 10 is also rotary symmetric and can be rotated about an angle of 60° to arrive at a column having an identical appearance; thus the column has $D_6$ symmetry.

The arrangement of light sources 2 and the central mirrored column 10 is shown in greater detail in FIG. 2. The surfaces 4 of the mirror column of FIG. 1 are shown in solid lines; an alternative form of the mirror column has smaller peaks 9' than the arrangement shown in FIG. 1 formed by curved surfaces 4' shown in broken lines in FIG. 2 and as a whole in FIG. 3; the arrangement of peaks 8 are the same for both forms of mirror column.

The central mirrored column 10 is hollow and has a central passageway 12 through which air can be blown to cool the column 10 and the whole lighting apparatus.

The light sources of the lighting apparatus are supplied with alternating current from a three-phase source (although any other phase-shifted supply may be used instead); two light sources (usually those arranged on opposite sides of the mirror column) are connected to each phase and in this way the flickering of individual lamps due to the alternating current is scarcely visible in the lighting apparatus as a whole because while one pair of lamps are emitting light of a relative low intensity (i.e. at the minimum intensity of its cycle), the other four light sources are emitting light of an intensity near their maximum value and in this way the flickering of the lamps tends to even out.

It is possible to provide any number of light sources in the lighting apparatus of the present invention although the number is preferably a multiple of the number of phases of the alternating current supply, e.g. for a 3 phase supply, 3, 6, 9 etc. light sources may be provided.

The central mirrored column 10 reflects light away from the light sources and so the reflected light does not significantly increase the temperature of the light sources and consequently they have a relatively long service life. Because the thermal load on the apparatus of the present invention is low, the mirror surfaces do not degrade quickly leading to an improved service life for the apparatus as a whole as well as the light sources in particular. To reduce the thermal load on the light sources further, the peaks 9 and 9' of mirror column 10 extend into the annulus 5 to provide thermal shielding between neighbouring light sources. As a result of such shielding, for a lighting apparatus of identical volume, light sources of greater total light output can be used at the same thermal load. At the same time the optical efficiency of the lighting apparatus is also improved.

FIG. 3 shows an alternative shape of the central internal mirrored column 10 indicated by dotted lines 4' in FIG. 2. The lighting apparatus of FIG. 3 is otherwise identical to that shown in FIG. 1 (and so will not be described further in detail and the same reference numbers have been used to indicate identical features). Although the mirror of FIG. 3 provides less shielding than that of FIG. 1, it still provides substantial shielding while at the same time allowing better air circulation around the light sources, thereby improving the cooling of the light sources.

The shapes of the mirrored columns of FIGS. 1 to 3 were derived as follows (with reference to FIG. 2): A plasma light source 2 enclosed in an envelope 2a is mirrored in notional plane 6 to produce an image 2' and the next light source is placed at this position. The surface 4, 4' of the mirror column 10 must be placed at a distance from the light sources 2, 2', which distance is determined by the diameter of the glass envelope 2a of the light source and the intensity of the output of the light source falling on the surface of the mirror; this is because a small portion of the radiated output is always absorbed at the surface of the mirror and heats it up. For a given mirror material, the temperature produced in this way is an absolute limiting factor in the construction of the lighting apparatus since if the temperature is too high, the mirror melts or becomes degraded. The mirrored column is preferably made of stainless steel or titanium although aluminium may be used for low intensity applications.

We have found that the geometrical configurations of surfaces 4, 4' shown in FIG. 2 provide the lowest heat load; however, these configurations cannot be described as sections of simple mathematically-definable shapes, (i.e. they cannot be given by any single function) but their individual sections can be given. In a preferred embodiment the shape of each curved surface 4, 4' is made up of individual curves extending between planes 6 and 6' and each individual curve is a transformed sinusoidal curve, i.e. a sinusoidal curve whose amplitude and/or frequency has been altered and/or which has been rotated; the curves 4, 4' have inflection point 7, 7' and their peaks 8, 9 and 8', 9' are the intersection lines of the sinusoidal curve and the planes of symmetry 6 and 6'. The three transformations (or parameters) of the sinusoidal section described above can be optimized mathematically in such a way that the least possible amount of radiation emitted from the plasma light sources should return after reflection into the plasma. Using the lighting apparatus of FIGS. 1, 2 and 3 only 3–4% of the total emitted is reflected back into the light sources. This protects the light sources from overheating and in addition has the result that the employed internal mirrors do not overheat and their reflectivity properties do not deteriorate. The shielding provided by peaks 9, 9' means that little (if any) of the light from one light source 2 can fall directly on neighbouring light source 2', thereby considerably reducing the heat load on the light sources and increasing the efficiency of the apparatus as a whole.

In the course of our experiments we tried to make the surface of the mirrored column at least partially diffusing and we found in this case that, accompanied by a slightly reduced efficiency, the light distribution of the lighting apparatus was improved.

We have also examined central mirrored columns having surfaces 4, 4' which can be described by other 'power' equations, for instance the involutes of parabolas or curves of higher powers or of cylindrical surfaces. We found that the minimum thermal load on the internal mirror and on the radiating plasma comes about when the central mirror is symmetrical in shape and this arrangement also gives the maximum of the light emission. At a thermal optimum, the efficiency of our lighting apparatuses improved by 30% and the light flux reaching the target object is improved by 15%. Thus by an empirical method we found that the employment of an internal mirror significantly increases the efficiency of the lighting apparatus while at the same time the additional heat load on the light sources is reduced. It became clear from our experiments that the optimum benefit of the central internal mirror can be realised with an internal mirror arrangement in which the individual segments may be derived in such a manner that it is mirrored in a notional plane 6 and then mirrored again in a new plane 6' until the serial mirrorings in planes accurately attain the starting position, along the pitch circle of the light sources and when a peak 9, 9' extends into the annulus on which the light sources are arranged to provide shielding between adjacent light sources.

We claim:

1. A lamp structure which comprises:

(i) a concave reflector having an axis (ii) a plurality of light sources, wherein the number of light sources is N, said light sources being spaced apart within said reflector and arranged about said axis on a notional annulus (iii) a body disposed within the reflector substantially concentrically about said axis said body having a plurality of reflective segments on its surface outwardly from said axis, the number of reflective segments being N or a multiple of N, each segment viewed in cross-section having at least two curved surfaces that meet together in a peak, each light source being located opposite to the peak of a respective segment, and wherein intermediate between each pair of adjacent light sources, the body includes a further peak that extends into the notional annulus on which the light sources are arranged to shield the adjacent light sources from each other.

2. The lamp structure of claim 1, wherein the said body has $D_N$ or $C_N$ symmetry.

3. The lamp structure of claim 1, wherein each curved surface of each segment, in cross-section, has a geometric shape corresponding to a section of a circle, of a sinusoidal wave or of the involute of a parabola or of a curve of higher power.

4. The lamp structure of claim 3, wherein the said geometric shapes have been stretched, contracted, stretched and contracted, rotated, stretched and rotated, contracted and rotated or stretched and contracted and rotated.

5. The lamp structure of claim 1, wherein the reflecting surfaces of the central mirrored body are partially diffusing.

6. The lamp structure of claim 1, wherein each of the said further peaks extends into the said annulus but does not extend completely through the said annulus.

7. The lamp structure of claim 1, wherein the concave surface of the reflector has the shape of a body of rotation.

8. The lamp structure of claim 7, wherein the reflector has the shape of a higher order than a paraboloid.

9. The lamp structure of claim 8, wherein the reflector has an annular focal area and the said light sources are arranged in the vicinity of that area.

10. The lamp structure of claim 1, wherein separate light sources are connected to separate phases of a phase-shifted alternating current supply.

* * * * *

UNITED STATES PATENT AND TRADEMARK OFFICE

CERTIFICATE OF CORRECTION

PATENT NO. : 4,965,876

DATED : October 23, 1990

INVENTOR(S) : Tividar Foldi, et al.

It is certified that error appears in the above-identified patent and that said Letters Patent is hereby corrected as shown below:

The title page, showing the illustrative figure, should be deleted to be replaced with the attached title page.

Replace sheets 1 and 2 of the drawing, containing figures 1a, 1b, and 2, with new sheets 1 and 2 containing figures 1a, 1b, and 2, as shown on the attached pages.

Signed and Sealed this

Seventh Day of April, 1992

*Attest:*

HARRY F. MANBECK, JR.

*Attesting Officer*

*Commissioner of Patents and Trademarks*

United States Patent [19]

Földi et al.

[11] Patent Number: 4,965,876

[45] Date of Patent: Oct. 23, 1990

[54] LIGHTING APPARATUS

[76] Inventors: Tivadar Földi, Irinyi u. 36/b, 1117-Budapest; Gábor Biró, Gönczy u. 2, 1093-Budapest; Tamás Barna, Ady E. u. 9/d, 1024-Budapest; Imre Nagy, Béla u. 92, 1165, Budapest; László Vincze, Uzsoki 12, 1145-Budapest, all of Hungary

[21] Appl. No.: 357,366

[22] Filed: May 26, 1989

Related U.S. Application Data

[63] Continuation-in-part of Ser. No. 107,952, Oct. 13, 1987, abandoned.

[30] Foreign Application Priority Data

Oct. 13, 1986 [HU] Hungary ..... 4254/86

[51] Int. Cl.[5] ..... F21V 7/00

[52] U.S. Cl. ..... 362/247; 362/346; 362/240; 362/298; 350/619

[58] Field of Search ..... 362/235, 240, 241, 243, 362/238, 247, 341, 346, 347, 350, 296, 297, 298, 301, 307, 252; 350/619, 620

[56] References Cited

U.S. PATENT DOCUMENTS

| | | | |
|---|---|---|---|
| 3,264,467 | 8/1966 | Mann et al. | 362/234 |
| 3,686,940 | 8/1972 | Kockott | 362/252 |
| 4,651,257 | 3/1987 | Gehly | 362/298 |
| 4,816,694 | 3/1989 | Kuppenheimer, Jr. | 362/282 |

FOREIGN PATENT DOCUMENTS

| | | | |
|---|---|---|---|
| 1227404 | 10/1966 | Fed. Rep. of Germany | |
| 859696 | 12/1940 | Switzerland | 362/298 |
| 282255 | 12/1927 | United Kingdom | 362/350 |

*Primary Examiner*—Ira S. Lazarus
*Assistant Examiner*—D. M. Cox
*Attorney, Agent, or Firm*—Schweitzer & Cornman

[57] ABSTRACT

A lighting apparatus is provided having a plurality N of light sources arranged annularly around the optical axis of a reflector. The efficiency of such an apparatus and its service life are improved by providing a central mirrored column which is symmetrically disposed with respect to the light sources. The column has $C_N$ or $D_N$ symmetry and reflects light emitted by the light sources away from the light sources themselves, thereby reducing the amount of light reflected back at the light sources and reducing their thermal load. The column has peaks that extend into the notional annulus on which the light sources are arranged to shield adjacent light sources from each other.

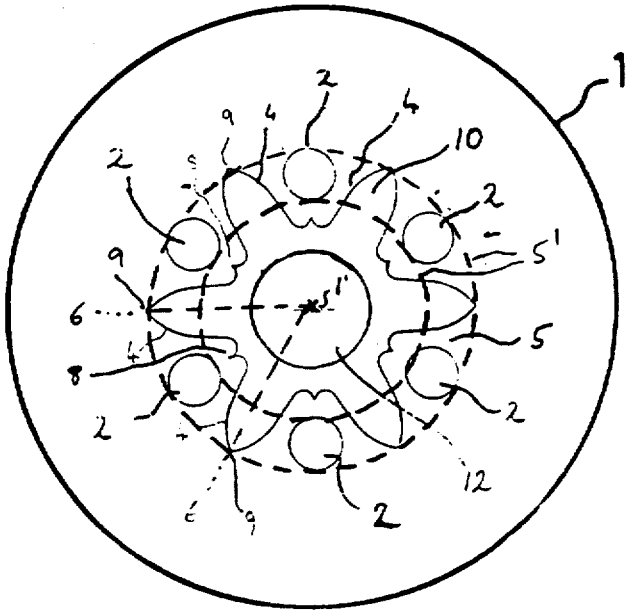

10 Claims, 3 Drawing Sheets